US011358757B2

(12) United States Patent
Bitzaya

(10) Patent No.: US 11,358,757 B2
(45) Date of Patent: Jun. 14, 2022

(54) LID FOR A CUP

(71) Applicant: Dennis Bitzaya, Middletown, CT (US)

(72) Inventor: Dennis Bitzaya, Middletown, CT (US)

( * ) Notice: Subject to any disclaimer, the term of this patent is extended or adjusted under 35 U.S.C. 154(b) by 73 days.

(21) Appl. No.: 16/679,490

(22) Filed: Nov. 11, 2019

(65) Prior Publication Data

US 2021/0139204 A1 May 13, 2021

(51) Int. Cl.
*B65D 43/02* (2006.01)
*G01K 11/12* (2021.01)

(52) U.S. Cl.
CPC ..... *B65D 43/0214* (2013.01); *B65D 2203/12* (2013.01); *B65D 2543/00046* (2013.01); *B65D 2543/00092* (2013.01); *B65D 2543/00537* (2013.01); *B65D 2543/00796* (2013.01)

(58) Field of Classification Search
CPC ..... B65D 43/0214; B65D 2203/12; B65D 2543/00046; B65D 2543/00092; B65D 2543/00537; B65D 2543/00796; B65D 47/265; B65D 5/4212; B65D 79/02; B65D 2203/00; B65D 2203/04; B65D 43/0208; B65D 43/18; B65D 47/261; B65D 47/263; B65D 47/266; B65D 47/268; A47G 19/2272
USPC ..... 220/254.3, 253, 716, 719; 206/459.1
See application file for complete search history.

(56) References Cited

U.S. PATENT DOCUMENTS 10,421,587 B2 * 9/2019 Gilbert ..... B65D 51/1683
2002/0038803 A1 * 4/2002 Malcolm ..... B65D 47/06 220/713
2003/0089713 A1 * 5/2003 Belt ..... B65D 47/265 220/253
2006/0027588 A1 * 2/2006 Mackovic-Basic ..... B65D 47/265 220/795
2017/0208975 A1 * 7/2017 Ross ..... B65D 43/14

* cited by examiner

*Primary Examiner* — Andrew D Perreault
(74) *Attorney, Agent, or Firm* — IP Attorneys Group, LLC

(57) ABSTRACT

The current invention relates to a lid for a cup which protects the contents of the cup and the drinking hole from contaminants. In some embodiments the lid for a cup includes a base and a cover connected to the base which rotates around the base. In this way the cover protects the drinking hole when closed, but can rotate open to allow the user to access the drinking hole and the contents of the cup. In some embodiments the cover is further equipped with a stopper which fits into the drinking hole and helps secure the cover in a closed position. In other embodiments the base is further equipped with a ramp leading up to the drinking hole which guides the cover to the drinking hole and locks the stopper within the hole. In other embodiments a protective layer is provided over the base which is removed before use.

19 Claims, 8 Drawing Sheets

LID FOR A CUP

BACKGROUND OF THE INVENTION

The present invention relates to lid for a cup which protects the drinking hole from germs or other contaminates.

Many people all over the world make or order coffee, tea, or other beverages every day. On the top of the cup where the beverage is poured is often placed a lid which can limit spilling and trap heat. Many times, these lids have a simple uncovered hole for drinking out of, which can expose the beverage to dust, germs, or other particles floating in the air. Similarly, when the lid is placed onto the cup, it is often pushed down on by hand, which can be contaminated by germs, dirty from handling money, or contaminated with allergens from other foods. Thus, these contaminates from the hand can then transfer to the drinking hole, which the user subsequently puts their mouth on, transferring these contaminates into their body, which can cause sickness or other ailments.

In addition to the issue discussed above, the lids with simple drinking holes discussed above typically have a number of functional limitations. First, the beverage inside of the cup can splash up out of the hole if the cup is jostled or bumped. This can cause a mess for the user to have to clean up, results in a waste of the contents of the cup, and can be a safety hazard if the beverage is hot. The beverage can also leak out of the connection between the lid and cup as often these joints are not secure, leading to the beverage dripping from the seal when drinking. Second, as discussed above, the simple uncovered hole is typically open to the outside air, which can allow heat from a warm beverage to escape faster than desired, leading to a cold drink when the user eventually drinks it. This can be an especially prominent problem for beverages which are delivered or are otherwise ingested some time after purchasing the beverage.

While splashing hot beverages can be a safety hazard, so can drinking hot beverages. In many cases it can be difficult to tell whether the beverage inside of a cup is cool enough to drink without taking a sip or lightly touching the beverage, both of which can cause mild burns or discomfort if the beverage is still too hot.

It is clear from the many limitations of current beverage lids that a new type of lid which properly covers the drinking hole and protects the contents of the cup as well as the user is necessary. In addition to covering the drinking hole, the lid for a cup should also ideally limit the liquid inside of the cup from splashing out of the lid, whether that be from the drinking hole or the seal between the lid and the cup, and it should tell the user the approximate temperature of the liquid so that the user knows if it is safe to drink.

SUMMARY OF THE INVENTION

The present invention relates to lid for a cup which protects the drinking hole from germs or other contaminates.

In some embodiments the lid comprises a base, a hole in the base which the user can drink out of, a cover affixed to the base which rotates clockwise or counterclockwise around the base, and a stopper on the cover. In many embodiments the stopper is removably attached within the hole.

In some embodiments the stopper extends from the cover and is integrally connected to the cover. In other embodiments the stopper is not integrally connected to the cover but is placed through the cover and secured to the cover. In other embodiments the stopper is not secured to the cover but still placed through the cover. For some embodiments where the projection is not integrally connected to the cover, the projection shifts up and down with respect to the cover and the base. In many of these embodiments the closed position of the stopper is when the stopper is removably attached within the hole on the base, and the open position is when the stopper is removed from the hole. In many embodiments the vertical movement of the stopper is halted by a feature selected from the group consisting of material section, projection, tab, and combinations thereof.

In some embodiments the base further comprises a ramp which guides the stopper and cover up to the hole. In some embodiments the ramp is build on the top surface of the base. In some embodiments where the ramp is built upon the top surface of the base the ramp is hollow, and in others it is solid.

In many embodiments the lid further comprises a securing projection with securing ribs within the securing projection which helps secure the lid to a cup and prevents leaks. In some embodiments the base is further equipped with a splash guard which keeps liquid from splashing up out of the hole when the cup is placed on a hard surface or jostled. In some embodiments the splash guard projects from the outer perimeter of the base towards the inner perimeter and in other embodiments the splash guard projects from the inner perimeter of the base towards the outer perimeter. In some embodiments the base is further equipped with a splash guard stopper which halts the vertical movement of the splash guard when the cup is inverted.

In some embodiments the base further comprises adjustment ridges which help the cover shift up and down with respect to the base. In some embodiments the base and cover each comprise a feature which helps secure the cover in the open, closed, or other position. In many embodiments these features are a ridge or a projection.

In some embodiments the base further comprises at least one heat indicator which tells the user the approximate temperature of the continents of the cup. In some embodiments with heat indicators, the base further comprises heat wells near the heat indicator which help trap the heat around the heat indicator.

In some embodiments the cover is further equipped with at least one gripping projection which helps the user rotate the cover.

In some embodiments the lid is further equipped with a protective layer which is removed before use which gives added protection. In some embodiments this protective layer is equipped with a tab to help in the removal of the layer.

DETAILED DESCRIPTION OF THE INVENTION

Figure 1:
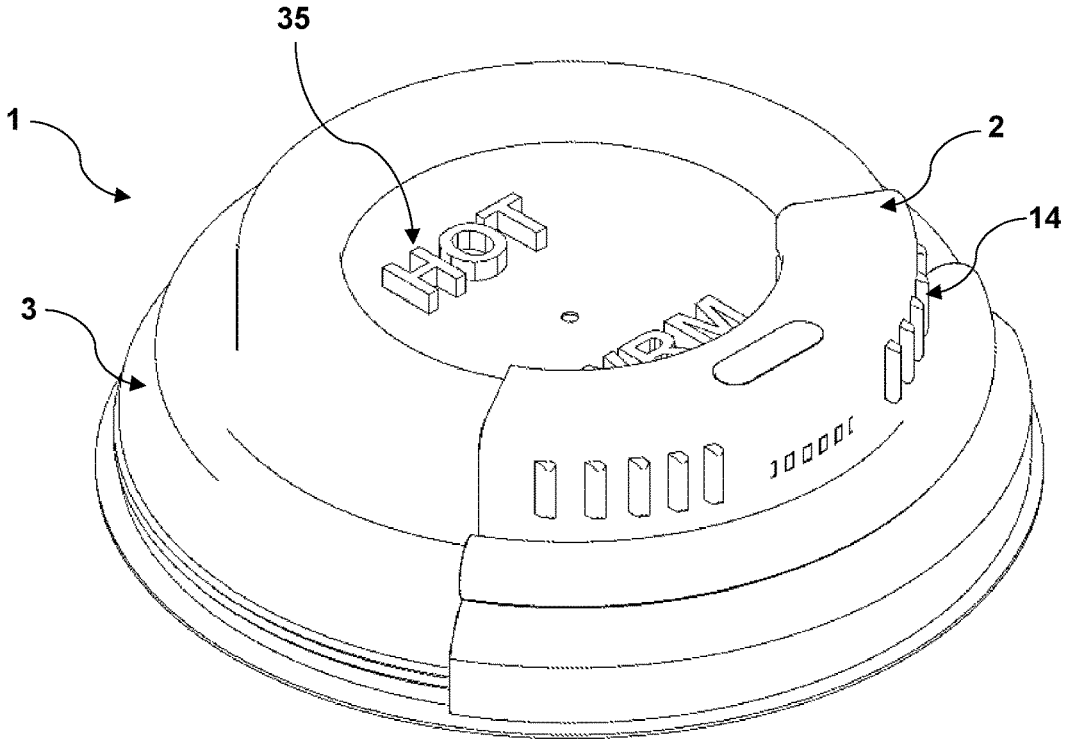
FIG. 1 shows a closed perspective view of a lid for a cup according one embodiment of the invention.
Figure 2:
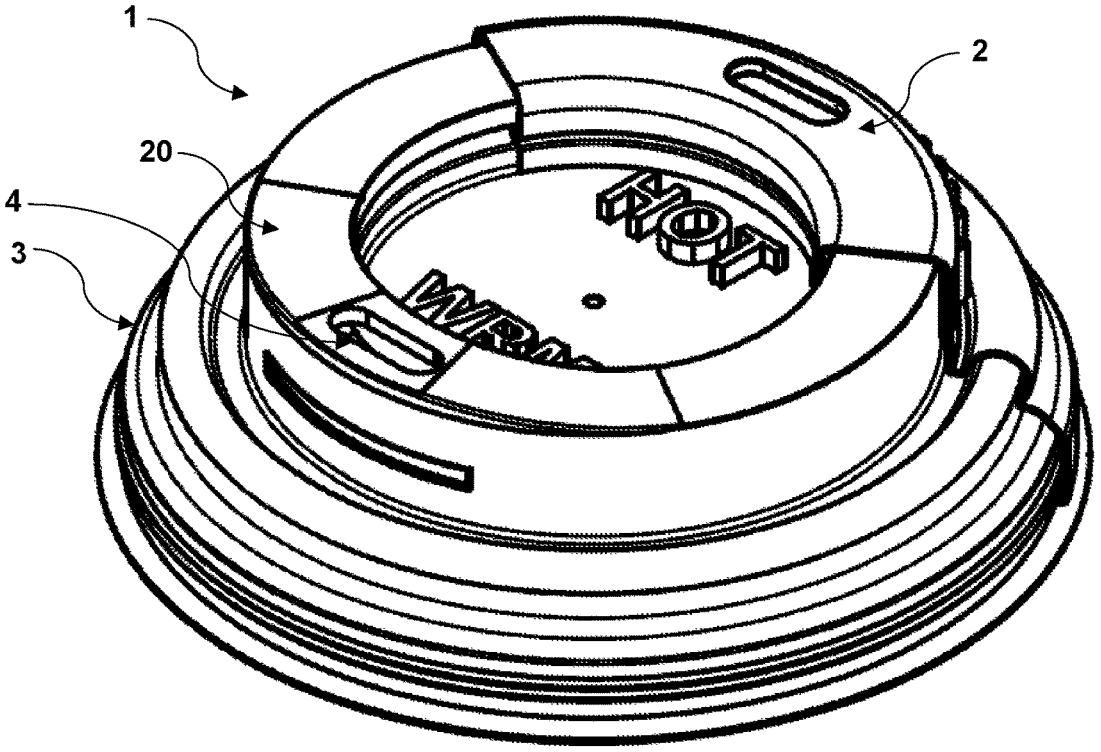
FIG. 2 shows an open perspective view of the lid for a cup shown in FIG. 1.
Figure 3:
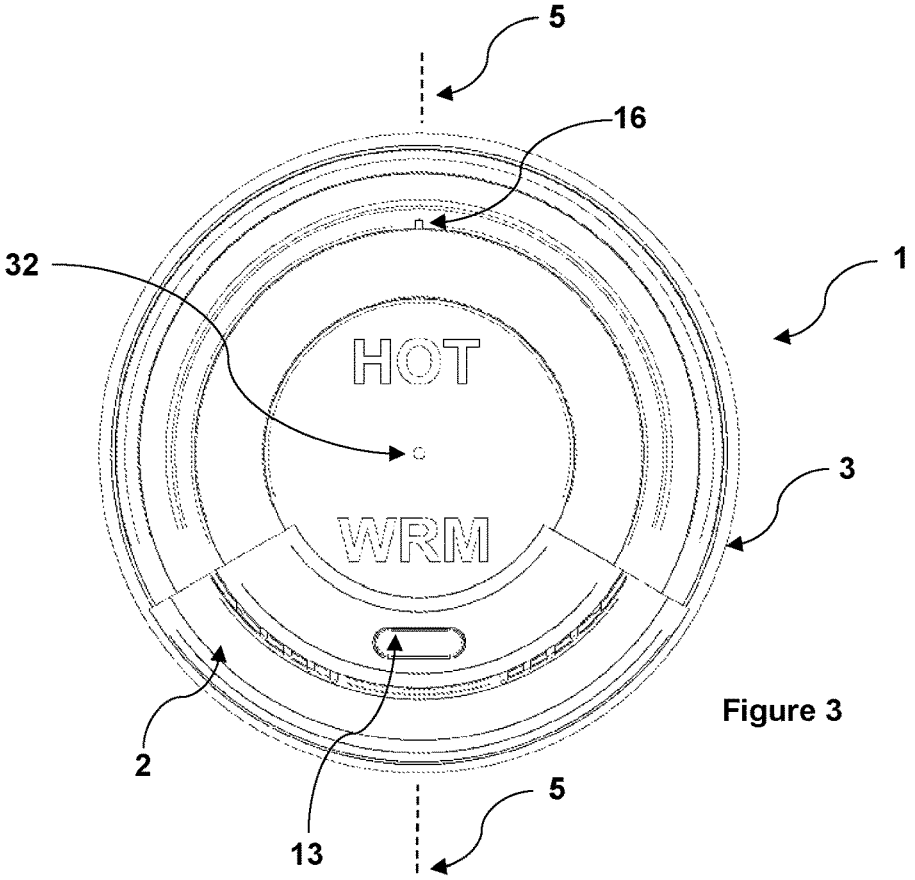
FIG. 3 shows a closed top view of the lid for a cup shown in FIG. 1.
Figure 4:
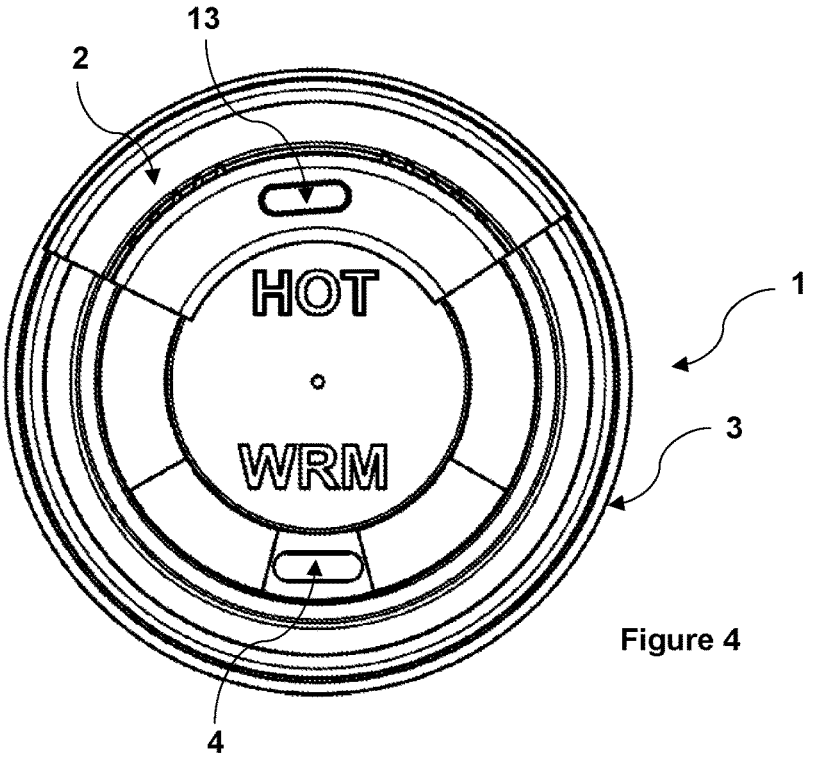
FIG. 4 shows an open top view of the lid for a cup shown in FIG. 1.

The present invention relates to lid for a cup which protects the drinking hole from germs or other contaminates. FIGS. 1 and 2 show perspective views of lid 1 which comprises a base 3 and a cover 2. FIG. 1 shows a view with cover 2 closed and FIG. 2 shows a view with cover 2 open, exposing drinking hole 4. In most embodiments cover 2 opens and closes by rotating around the outer surface of base 3. When closed, cover 2 covers and protects drinking hole 4, and when open, cover 2 leaves drinking hole 4 exposed. As seen in FIGS. 3 and 4, which show a top view of an embodiment of lid 1, in most embodiments cover 2 rotates in a clockwise or counterclockwise direction around base 3. In these embodiments, cover 2 is in the fully closed position when generally centered over drinking hole 4, in most embodiments having stopper 13 removably attached within drinking hole 4, as seen in FIG. 3, and cover 2 is in the fully opened position when generally centered across from drinking hole 4, as seen in FIG. 4. As is evident, however, cover 2 can be open without being fully opened, where part of drinking hole 4 is exposed, or drinking hole 4 is fully open but cover 2 is not generally centered across from drinking hole 4. Similarly, cover 2 can be partially closed, when drinking hole 4 is fully covered, but cover 2 is not generally centered over drinking hole 4.

This description uses the terms molded and punched interchangeably, both referring to the general process of manufacturing the various parts of lid 1. These terms are not intended to be limiting as to the type of manufacturing method or style.

Figure 5:
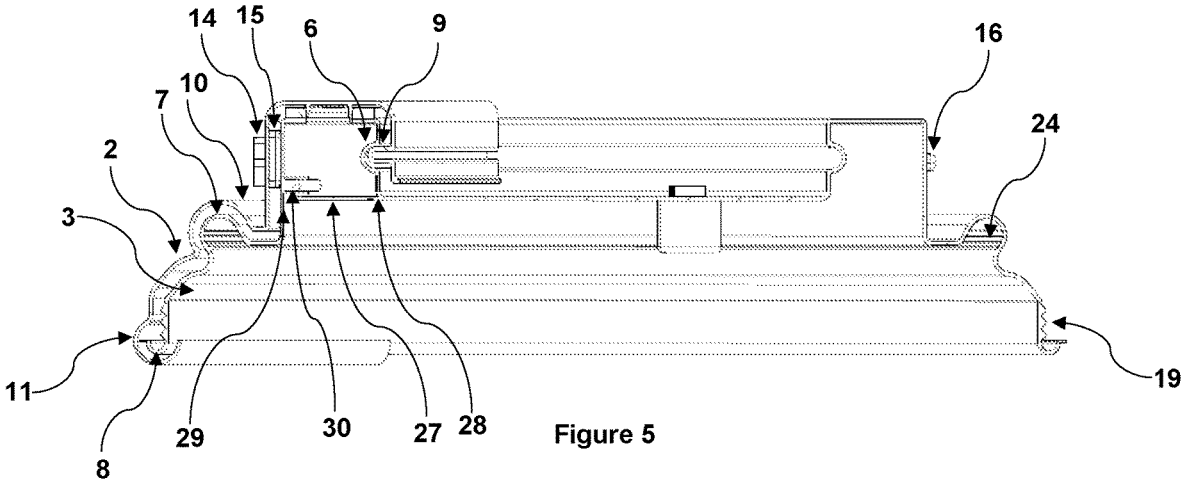
FIG. 5 shows a cross-sectional view of the lid for a cup shown in FIG. 1.
Figure 6:
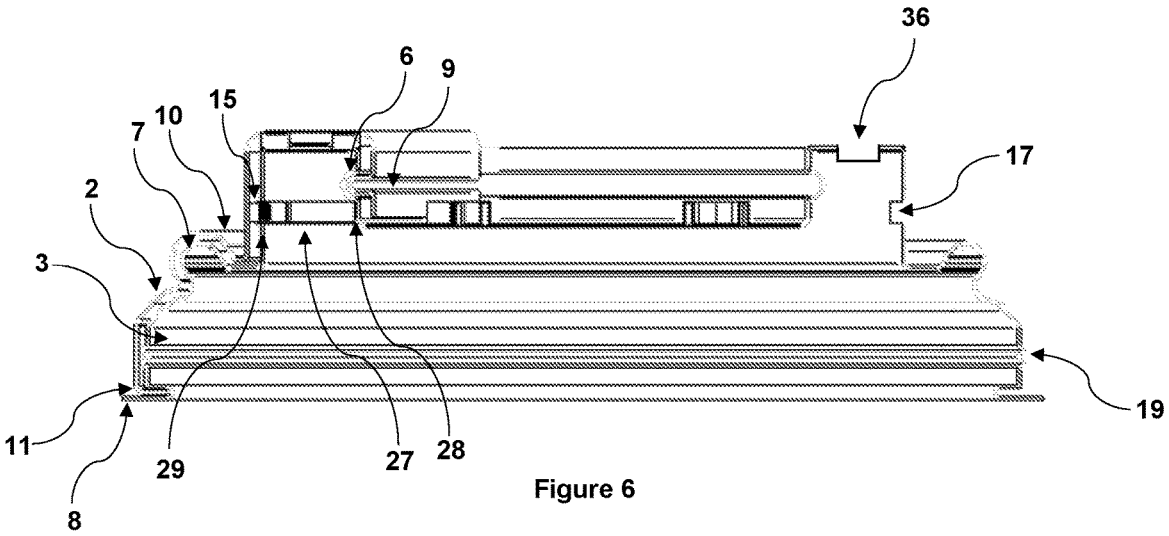
FIG. 6 shows a cross-sectional view of another embodiment of the lid for a cup as the one shown in FIG. 1.

As seen in FIGS. 5 and 6, which show cross-sectional views of lid 1 along the dotted line 5 of FIG. 3, in most embodiments cover 2 is affixed to base 3 by mating projections and ridges. As seen in FIG. 5, in many embodiments there are three main projections or ridges on base 3, namely rotational ridge 6, securing projection 7, and terminal projection 8, which interact with rotational projection 9, securing projection 10, and terminal projection 11 on cover 2, respectively. In some embodiments, as in the one shown in FIG. 5, terminal projection 11 encapsulates terminal projection 8, and in other embodiments, as in the one shown in FIG. 6, terminal projection 11 is encapsulated by terminal projection 8. In some embodiments the ridges and projections are as shown in FIGS. 5 and 6, and in other embodiments they are reversed, for example base 3 having a rotational projection rather than ridge 6 and cover 2 having a rotational ridge rather than projection 9.

In many embodiments cover 2 is provided with gripping projection 14 to aid the user in rotating cover 2. In come embodiments gripping projection 14 is provided on the side of cover 2, an example of which can be seen in FIG. 1, in other embodiments gripping projection 14 is provided on the top of cover 2, and in other embodiments gripping projection 14 is provided on both the top and side of cover 2. Embodiments where gripping projection 14 is on the side of cover 2 are useful as this allows the user to shift cover 2 with their thumb while holding a cup covered by lid 1. Embodiments where gripping projection 14 is on the top of cover 2 are useful as the alternate hand can more easily access the top of cover 2 than the side, and embodiments where gripping projection 14 is on both the side and top are useful as it gives the user the ability to rotate cover 2 by whichever means they prefer. In some embodiments there is only one gripping projection 14 and in others there are multiple gripping projections 14.

In other embodiments cover 2 is provided with at least two fastening projections 15 on the inside of cover 2. In some embodiments when cover 2 rotates to the open position, locking projection 16 on base 3 fits between fastening projections 15, which locks cover 2 in an opened position. Locking in an open position is important as it allows the user to tip and drink out of cup 25 without having to hold cover 2 open. If this was not the case cover 2 could slide back into a closed position and interrupt their drink or splash liquid onto the user. In some embodiments locking projection 16 is generally opposite of drinking hole 4 and fastening projections 15 generally centered on cover 2, such that cover 2 is locked in the fully open position. In other embodiments either locking projection 16 or fastening projections 15 are in different positions such that cover 2 is locked in an open position but not the fully opened position. Locking cover 2 in the fully open position moves cover 2 as far away from drinking hole 4, and is the most aesthetically pleasing, while locking cover 2 in another open position allows cover 2 to stay open without having to twist it fully to the other side of base 3. In some embodiments there are multiple locking projections 16 such that cover 2 can be locked in an open position which is either to the left or right of drinking hole 4, which gives the user the option of which direction they open cover 2. This option is useful as depending on which hand the user is holding their cup in, cover 2 may be more easily pushed in one direction versus the other. In other embodiments there is a locking projection 16 located near drinking hole 4 which locks cover 2 in the closed position, but in many embodiments cover 2 is locked in the closed position by stopper 13 being removably attached within drinking hole 4. In other embodiments locking projection 16 fits into the backside of gripping projection 14, which locks cover 2 in an open or closed position.

In other embodiments locking ridge 17 is provided on base 3 which fastening projection 15 fits into as a means of locking cover 2 in an open or closed position. These embodiments beneficially allow cover 2 to be only equipped with one projection 15. In some embodiments locking ridge 17 is provided along with locking projection 16, and in other embodiments only locking ridge 17 or locking projection 16 is provided. In some embodiments multiple locking ridges 17 are provided.

Figure 7A:
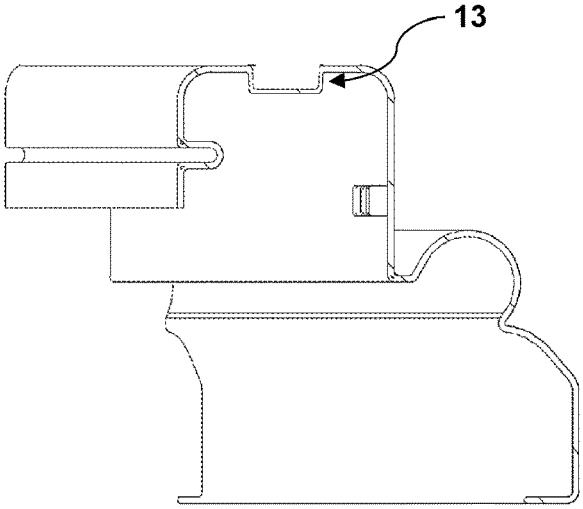
FIG. 7A shows a first type of stopper style for the lid for a cup shown in FIG. 1.
Figure 7B:
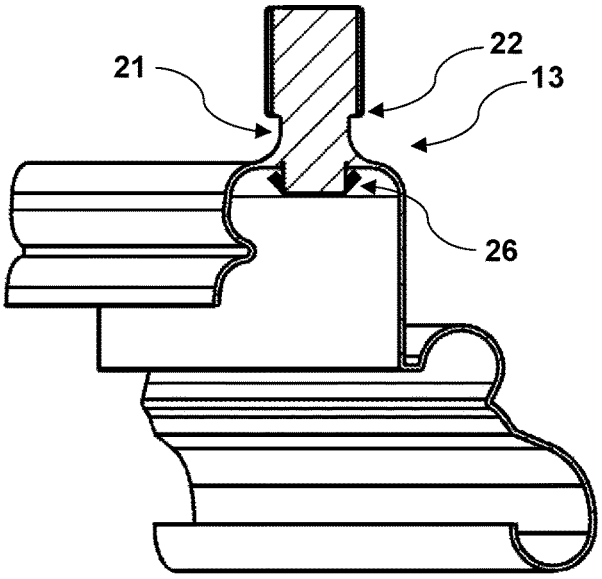
FIG. 7B shows a second type of stopper style for the lid for a cup shown in FIG. 1.
Figure 7C:
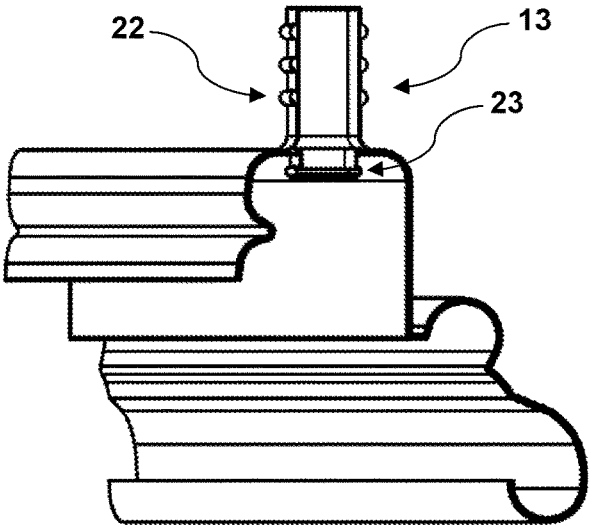
FIG. 7C shows a third type of stopper style for the lid for a cup shown in FIG. 1.

As discussed above, in many embodiments stopper 13 is removably attachable inside of drinking hole 4 which locks cover 2 in a closed position. In many embodiments stopper 13 projects down from the top surface of cover 2. Having stopper 13 act as the locking mechanism beneficially keeps cover 2 closed and avoids the possibility that cover 2 shifts open during travel, exposing drinking hole 4 to the air. Additionally, using stopper 13 as the projection which is removably attachable into drinking hole 4 avoids having to add additional locking features to either cover 2 or base 3, thus reducing the complexity of manufacturing. In other embodiments, stopper divot 36 is provided on base 3 where stopper 13 is removably attachable into in order to lock cover 2 in an open position. As with drinking hole 4, these embodiments beneficially avoid having to add additional features to either cover 2 or base 3, thus reducing complexity of manufacturing. FIGS. 7A-C show different stopper embodiments, which will be discussed in more detail below.

FIG. 7A shows an embodiment of cover 2 where stopper 13 is projected downwards from cover 2, such that is does not generally move up and down with respect to the top surface of cover 2. These embodiments are especially useful when base 3 has ramp 20 which leads up to drinking hole 4, as will be discussed in more detail below. In some of these embodiments the bottom of stopper 13 rides along the top surface (23) of base 3, such that when stopper 13 moves over drinking hole 4 it falls within drinking hole 4. Then, when the user wants to open cover 2, they lift cover 2 slightly upwards, which pulls stopper 13 out of drinking hole 4, before rotating cover 2. This up and down movement is facilitated by vertical adjustment ridges 19 provided on some embodiments of base 3, which compress or extend to allow cover 2 to shift up or down.

FIG. 7B shows an embodiment of cover 2 where stopper 13 shifts up and down with respect to cover 2. These embodiments are useful when base 3 does not have ramp 20. In these embodiments, halting material section 21 fixes stopper 13 to cover 2 and prevents stopper 13 from being pulled up out of cover 2, and halting projection 22 halts stopper 13 from getting pushed too far into drinking hole 4. In these embodiments, when the user wants to lock cover 2 in a closed position, they place stopper 13 over drinking hole 4 and press down on stopper 13 until the bottom of halting projection 22 comes in contact with the top of cover 2. This action presses the bottom of stopper 13 into drinking hole 4, securing cover 2 in a closed position. Then when the user wants to open cover 2, they lift stopper 13 upwards until halting material section 21 is fully extended, which removes the bottom of stopper 13 from drinking hole 4 and allows cover 2 to rotate freely.

Similar to the embodiment shown in FIG. 7B is the embodiment shown in FIG. 7C. Instead of halting material section 21, in these embodiments stopper 13 is kept from being pulled up out of cover 2 by lower halting projection 23. In these embodiments, halting projection 23 has the added benefit of securing stopper 13 within drinking hole 4.

Also shown in FIG. 7B is another stopping mechanism, tab 26, which is useful when stopper 13 is a separate piece from cover 12. In these embodiments, when stopper 13 is initially pushed through the hole on cover 2, tab 26 lays flat against the side of stopper 13 and allows it to get inserted into the hole. After insertion, tab 26 expands outwards which keeps stopper 13 from being removed from cover 2. In some embodiments, tab 26 is provided as well as the other stopping mechanisms discussed above, such as halting material section 21 or lower halting projection 23, and in other embodiments tab 26 is provided without the other stopping mechanisms.

Having halting material section 21, lower halting projection 23, or tab 26 is useful to the embodiments shown in FIGS. 7B and C as it prevents stopper 13 from being removed from cover 2, which is important for two main reasons. First, since stopper 13 in most cases directly interacts with drinking hole 4, stopper 13 should remain generally inside of cover 2 to avoid interactions with germs or other contaminants. When stoppers are removed during use, often users place them on a nearby plate or table which could be unsanitary, then they put the contaminated stopper back into drinking hole 4. Second, if stopper 13 is removed it has the potential to be misplaced or lost.

In many embodiments, the outer perimeter of stopper 13 is chamfered, being slightly smaller at the bottom then at the top. The benefit of the chamfered perimeter is that it causes stopper 13 to fit more tightly within drinking hole 4. In other embodiments, stopper 13 is equipped with lower halting projection 23, which helps secure stopper 13 within drinking hole 4, as discussed above.

Figure 8A:
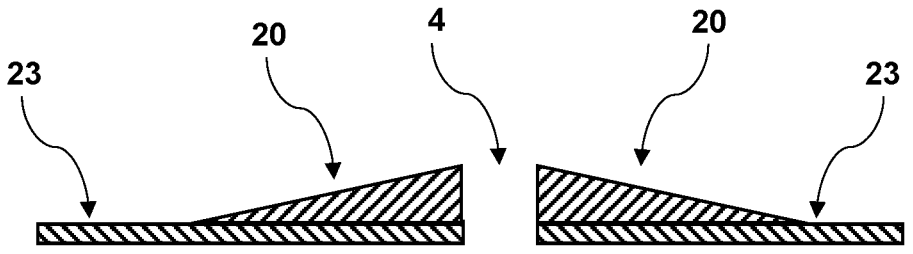
FIG. 8A shows a first type of ramp style for the lid for a cup shown in FIG. 1.
Figure 8B:
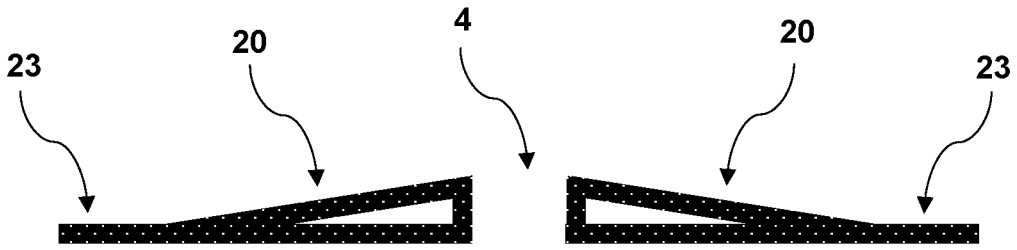
FIG. 8B shows a second type of ramp style for the lid for a cup shown in FIG. 1.
Figure 8C:
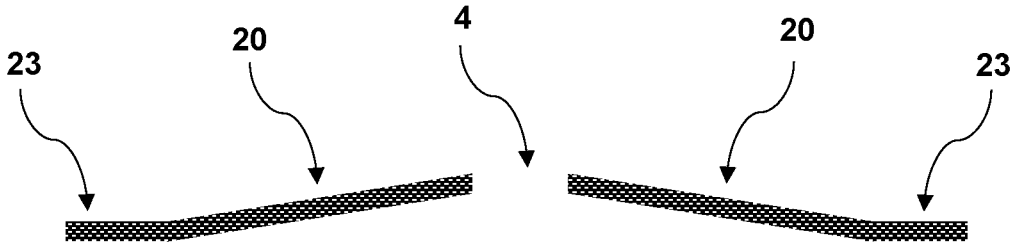
FIG. 8C shows a third type of ramp style for the lid for a cup shown in FIG. 1.

In some embodiments, as seen in FIG. 2, ramp 20 is provided on base 3 around drinking hole 4, which provides a number of benefits. First, ramp 20 gives the user a more stylized and ergonomic region to put their lips around when drinking through drinking hole 4. Second, in some embodiments, such as the embodiment shown in FIG. 8C, ramp 20 beneficially funnels the liquid from cup 25 to drinking hole 4. Third, as discussed above, for stopper embodiments such as the one shown in FIG. 7A, ramp 20 helps guide stopper 13 to drinking hole 4. FIGS. 8A-C show the three main ramp styles depending on the different embodiment. For the first embodiment of ramp 20, shown in FIG. 8A, the top surface (23) of base 3 remains generally level and a solid ramp 20 is built up on top of top surface 23. This embodiment beneficially gives stability and structure to ramp 20 due to its solid construction, which helps it be less suspectable to bending or breaking when cover 2 slides up and down on it. The second embodiment of ramp 20, shown in FIG. 8B is similar to the embodiment shown in FIG. 8A, where the top surface 23 of base 3 remains generally level, however, in this embodiment a hollow ramp 20 is built on top of top surface 23. This is beneficial as it allows the use of less material and can reduce the cost of manufacturing. Finally, the third embodiment of ramp 20, as shown in FIG. 8C, uses a ramped top surface 23 as ramp 20 rather than a ramp built on top of top surface 23. This embodiment is useful as it does not require additional molding steps or material, but simply molds the already present top surface 23 material, which reduces costs and complexities of manufacturing. Additionally, as discussed above, these ramp embodiments beneficially funnel the liquid up ramp 20 to drinking hole 4.

In some embodiments, both ramp 20 and stopper 13 are provided on lid 1, in other embodiments only ramp 20 is provided, and in other embodiments only stopper 13 is provided.

Figure 9:
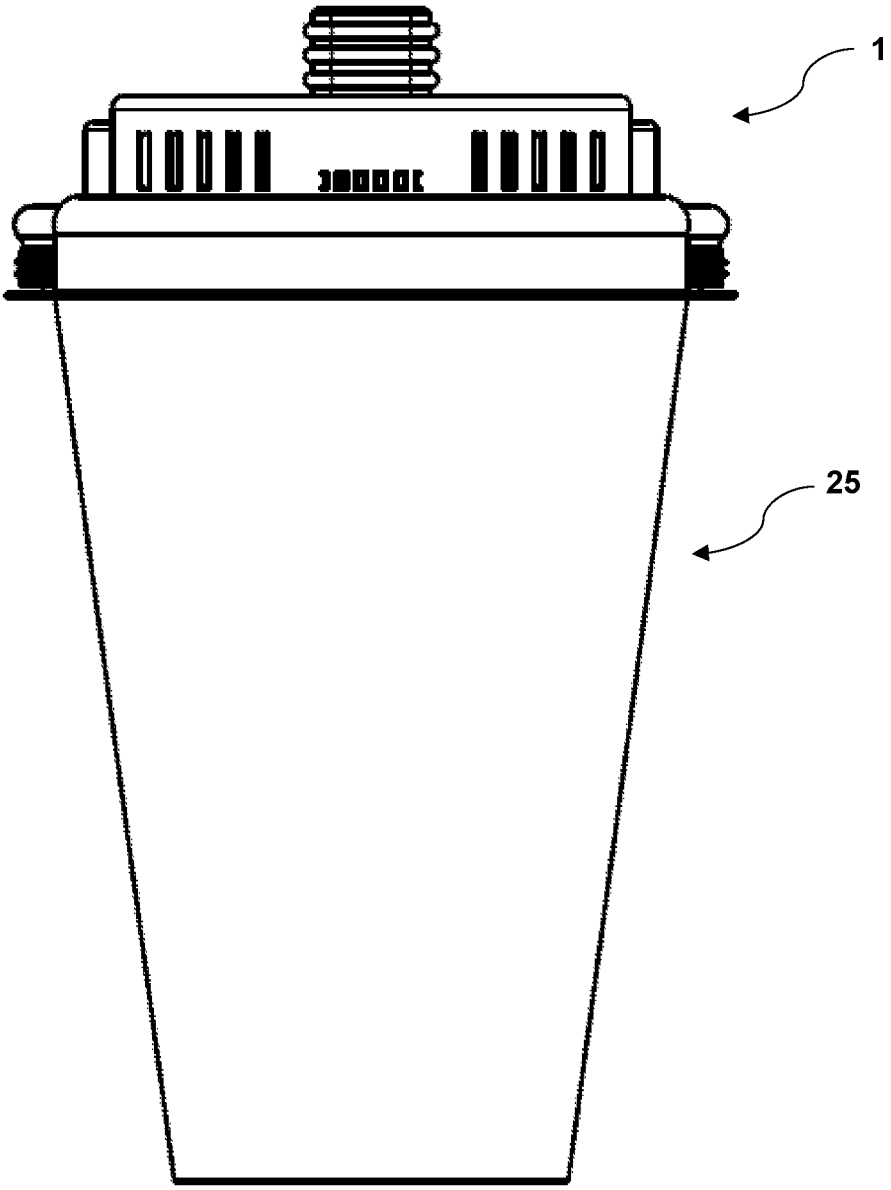
FIG. 9 shows a front view of the lid for a cup shown in FIG. 1 affixed to a cup.
Figure 10:
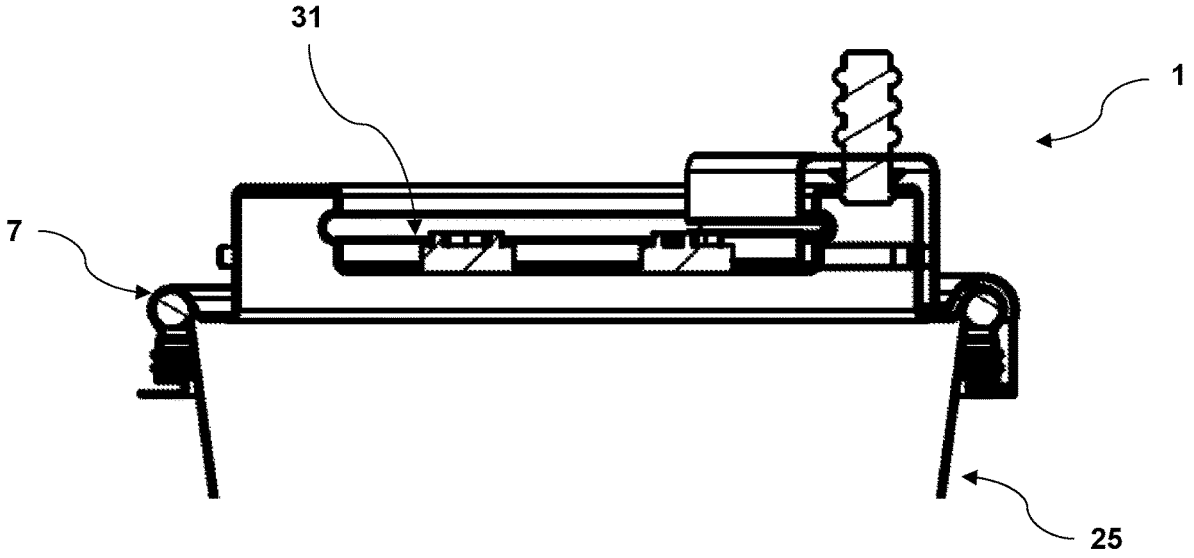
FIG. 10 shows a cross-sectional view of the lid for a cup shown in FIG. 1 affixed to a cup.

As shown in FIGS. 9 and 10, in most embodiments lid 1 attaches to the top rim of cup 25 via securing projection 7. In this manner, securing projection 7 wraps around and holds onto the outer rim of cup 25. In many embodiments securing rib 24 is provided within securing projection 7, as seen in FIG. 5. In some embodiments only one securing rib 24 is provided and in other embodiments multiple securing ribs 24 are provided. Securing rib 24 provides two main benefits. First, securing rib 24 gives securing projection 7 areas of extra tightness with which to hold onto cup 25, which makes lid 1 more secure. Second, securing rib 24 creates a seal which prevents liquid from leaking out at the seam between lid 1 and cup 25.

FIGS. 5 and 6 show different embodiments of splash guard 27, which beneficially prevents the liquid inside of the cup from splashing out drinking hole 4 when the cup is placed down on a table or other surface. As seen in FIG. 5, in some embodiments, splash guard 27 is a projection extending from the inner perimeter 28 of base 3 to almost the outer perimeter 29. In some of these embodiments, splash guard 27 is flexible so that straws can be put through drinking hole 4 and press splash guard 27 downwards in order that the straw reaches the liquid in cup 25. In some of these flexible embodiments, base 3 is further equipped with splash guard stopper 30, which prevents splash guard 27 from rising upwards with the weight of the liquid in cup 25 when inverted for drinking. In other embodiments, splash guard 27 is equipped with a relief which can be opened to allow a straw through splash guard 27. These embodiments beneficially give a solid splash guard but still allow a straw to be used with lid 1. In many of these embodiments splash guard stopper 30 is provided which prevents the opened splash guard 27 from rising upwards with the weight of the liquid in cup 25 when inverted for drinking.

In some embodiments, splash guard stopper 30 is a projection punched in from outer perimeter 29 towards inner perimeter 28. These embodiments are useful because the cavity in outer perimeter 29 caused by splash guard stopper 30 can be used to capture fastening projection 15 and lock cover 2 in the closed position, limiting the need to add additional locking features to either cover 2 or base 3, thus reducing complexity of manufacturing. In some embodiments splash guard 27 is a projection extending from outer perimeter 29 towards inner perimeter 28. In some embodiments, splash guard 27 extends across and is connected to both inner perimeter 28 and outer perimeter 29.

In other embodiments, such as the one shown in FIG. 6, splash guard 27 itself is a projection punched in from outer perimeter 29 towards inner perimeter 28. In other embodiments splash guard 27 is a projection punched from inner perimeter 28 towards outer perimeter 29. As with the splash guard stopper 30 embodiments discussed above, these embodiments are useful as the cavity in outer perimeter 29 caused by splash guard 27 can be used to capture fastening projection 15 and lock cover 2 in the closed position, limiting the need to add additional locking features to either cover 2 or base 3, thus reducing complexity of manufacturing.

As mentioned above, splash guard 27 beneficially limits liquid from splashing up and out of drinking hole 4 when not desired. When the user wants to drink however, the liquid inside of cup 25 can flow around the sides of splash guard 27 and up towards drinking hole 4.

In some embodiments, base 3 is equipped with heat indicator 35, which tells the user the approximate temperature of the liquid inside of cup 25. In some embodiments only one heat indicator 35 is provided. In some of these embodiments, heat indicator 35 tells the user when the liquid inside of cup 25 is unsafe to drink, such as temperatures over 160° F. In other embodiments there are multiple heat indicators 35. In some of these embodiments, each heat indicator 35 has a different temperature window, which tells the user the approximate internal temperature so that the user can drink their beverage at the desired temperature. For example, a first heat indicator 35 could tell the user when the beverage is over 160° F., and thus unsafe to drink, a second heat indicator could tell the user when the beverage is over 120° F., and a third could tell the user when the beverage is over 80° F. Thus, some users may want to drink their beverage at about 140° F., so they would consume their beverage when the first indicator is "off" and the second and third indicators are "on" which means that the beverage is below 160° F. and above 120° F. Other users may want to drink their beverage at 100° F., thus they would consume their beverage when both the first and second indicators are "off" and only the third is "on." When all three indicators are "off" this can indicate that the beverage needs to be discarded or re-heated in order to bring the beverage back up to the desired temperature. In some embodiments the temperature range is punched into lid 1 which beneficially tells the user what is the range of heat indicator 35. In some embodiments this temperature punch is heat indicator 35 and in other embodiments it is supplied along with heat indicator 35.

In some embodiments, heat indicator 35 is a punched area painted with thermochromic paint. In some embodiments with multiple heat indicators 30, each indicator has different colored thermochromic paint to denote the different temperature, and in other embodiments all of the thermochromic paints are the same color, and the different temperature ranges are denoted by another method, such as by a label or punched letters. In some embodiments, heat indicator 35 is punched towards the inside of cup 25 and in other embodiments heat indicator 35 is punched outwards.

Figure 11:
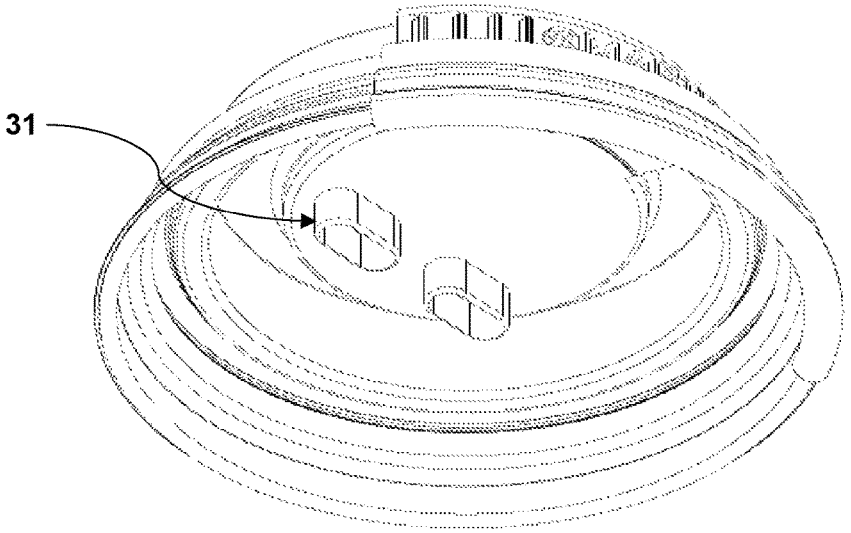
FIG. 11 shows a bottom perspective view of the lid for a cup shown in FIG. 1.

In some embodiments with heat indicator 35, heat well 31 is provided which aids in the trapping of the heat released from the liquid in order to make heat indicator 35 more effective, as seen in FIG. 11. In some embodiments head indicator well is punched towards the inside of cup 25 and in other embodiments heat well 31 is punched outwards. In some embodiments heat well 31 is positioned in the same direction as heat indicator 35, and in other embodiments they are in different positions.

As seen in FIG. 3, in some embodiments vent 32 is provided on base 3 which allows a small amount of air into cup 25 so that a vacuum is not generated when drinking. In some embodiments vent 32 is located on the top of base 3 and in other embodiments vent 32 is located on the side of base 3. In other embodiments vent 32 is a one-way valve which protects the contents of cup 25 from dust or other particles which may fall within vent 32. In some embodiments a sliding cover is provided over vent 32 which is opened when the user is drinking and closed when not is use as a means of protecting vent 32 from contaminates and keeping in heat.

Figure 12:
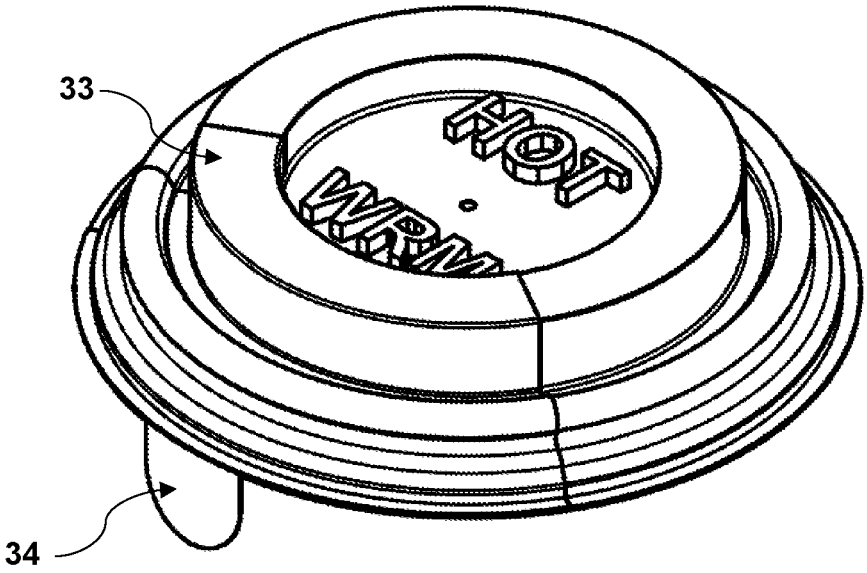
FIG. 12 shows a perspective view of the lid for a cup shown in FIG. 1, further equipped with a protective layer.
Figure 13:
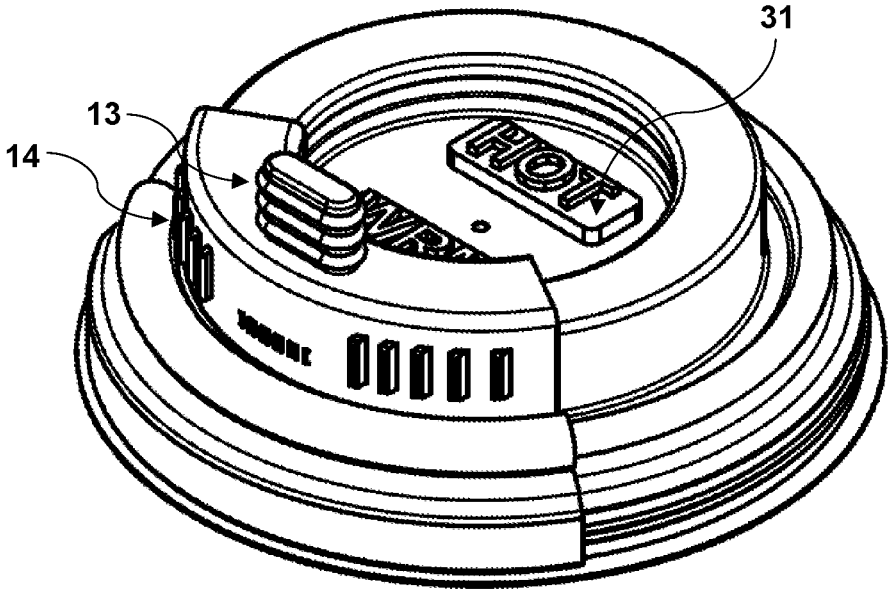
FIG. 13 shows a perspective view of another embodiment of the lid for a cup as the one shown in FIG. 1.

In some embodiments, lid 1 is further equipped with a protective layer 33 which is removed before use. In some embodiments protective layer 33 is permanently removed and in other embodiments protective layer 33 is temporarily removed when the user is drinking, and replaced when the cup is not in use. In some embodiments, such as the one shown in FIG. 12, layer 33 replaces cover 2, and in some embodiments layer 33 is placed over cover 2. Embodiments where layer 33 replaces cover 2 are useful as they reduce manufacturing costs and still completes the main purpose of protecting drinking hole 4 from contaminants while shipping and handling lid 1 before the user initially drinks from drinking hole 4. Embodiments where protective layer 33 is placed over cover 2 are useful as they give an extra layer of protection to lid 1. In some embodiments, tab 34 is provided which aids in the removal of protective layer 33. In some embodiments, protective layer 33 is pressed onto lid 1 during manufacturing which causes it to be affixed to lid 1 and in other embodiments protective layer 33 is equipped with an adhesive which causes it to be affixed to lid 1.

In some embodiments, protective layer 33 only covers a portion of lid 1, generally around drinking hole 4, in other embodiments protective layer 33 covers both drinking hole 4 and vent 32, and in other embodiments protective layer 33 covers the entire lid 1. In some embodiments, protective layer 33 is made of the same material as lid 1 and in other embodiments protective layer 33 is made of a different material as lid 1.

In many embodiments lid 1 is made of generally heat resistant material such as heat resistant plastics, silicon, metal, or wood. In many embodiments the material is also resistant to rusting. In some embodiments lid 1 is generally made of all the same material and in other embodiments lid 1 is generally made of different materials. Embodiments where lid 1 is made of all the same material are useful for ease of manufacturing, while embodiments where lid 1 is made of different materials is useful as different areas of lid 1 may function better with different materials. For example, in some embodiments heat well 31 is made of metal in order to better conduct the heat while the rest of lid 1 is made of silicon in order to be flexible and reduce costs.

In some embodiments, base 3 is all one layer and in other embodiments base 3 is more than one layer. In some embodiments with multiple layers each layer is made of generally the same material and in other embodiments with multiple layers at least some of the layers are made of different materials. Embodiments with multiple layers with different materials are useful as this allows lid 1 to be provided with insulation which keeps the contents of cup 25 at the desired temperature longer. Embodiments with a single layer are useful as this decreases manufacturing complexity and allows the lid to be more easily recycled if made from recyclable material.

In some embodiments, lid 1 is removable from cup 25 and in other embodiments lid 1 is integrally connected to cup 25.

While the present invention has been particularly described, it is evident that many alternatives, modifications and variations will be apparent to those skilled in the art in light of the foregoing description. For example, while hole 4 has been described as a drinking hole, lid 1 can be used for purposes other than drinking, such as pouring liquids or other materials out of hole 4. Thus, lid 1 is not limited strictly to drinking purposes. These descriptions and drawings are exemplary of specific embodiments only and are not intended to be limiting to the scope of the invention defined in the claims. It is therefore contemplated that the claims will embrace any such alternatives, modifications, and variations as falling within the true scope and spirit of the present invention.

What is claimed:

1. A lid for a cup comprising:

a base;

wherein said base comprises a top surface and a bottom;

wherein a vent is located approximately at the center of said base;

a ramp projecting upwards from said top surface;

a drinking hole in said ramp;

wherein a distance between said bottom and said drinking hole is greater than a distance between said bottom and said top surface;

a cover affixed to said base which comprises a generally flat upper surface;

said cover rotatablly attached to said base;

a stopper on said cover wherein at least a part of said stopper is moveably installed in said cover;

at least one adjustment ridge on said base which extends around an entire perimeter of said base;

at least one securing projection on said cover which engages with said at least one ridge;

wherein said engagement of said at least one projection with said at least one ridge facilitates the ability of said cover to rotate around an entire perimeter of said base such that said stopper is able to rotate around an entire circumference of said top surface;

wherein at least a part of said stopper is removably attachable within said drinking hole.

2. The lid for a cup according to claim 1, wherein said lid further comprises of said securing securing projection which secures said lid to said cup and wherein said securing projection further comprises at least one securing rib within said securing projection.

3. The lid for a cup according to claim 1, wherein said base further comprises a splash guard separate from and located below said hole, such that the distance between said hole and said bottom is greater than the distance between said splash guard and said bottom.

4. The lid for a cup according to claim 3;

wherein said base further comprises an outer perimeter and an inner perimeter;

wherein said splash guard projects from said outer perimeter towards said inner perimeter;

wherein said splash guard is generally parallel to said top surface.

5. The lid for a cup according to claim 1, wherein said base and said cover each further comprise at least one feature selected from the group consisting of said adjustment ridge, said securing projection, and combinations thereof, and wherein said features mate with one another to secure said cover in a position selected from the group consisting of open, closed, and combinations thereof.

6. The lid for a cup according to claim 1, wherein said base and said cover each further comprise at least one feature selected from the group consisting of an adjustment ridge, securing projection, and combinations thereof, and wherein said features mate with one another to secure said cover in a position selected from the group consisting of open, closed, and combinations thereof.

7. A lid for a cup comprising:

a base;

wherein said base comprises an outer perimeter and an inner perimeter and said base having a drinking hole, at least one locking projection and a vent hole;

a cover rotatablely attached to said base and there being a gap between said base and said cover;

at least one adjustment ridge on said base which extends around an entire perimeter of said base;

at least one securing projection on said cover which engages with said at least one ridge;

a ramp leading upwards from a top of said base;

a drinking hole in a top of said ramp, wherein a distance between said drinking hole and a bottom of said base is greater than a distance between said top of said base and said bottom of said base;

wherein said drinking hole comprises a length and a width;

a stopper extending downwards from said cover;

wherein at least a part of said stopper is removably attachable within said drinking hole;

wherein said base further comprises a splash guard located below said drinking hole and which extends across the length and width of said hole;

wherein said splash guard projects outwards from said inner perimeter towards said outer perimeter;

wherein said base has a splash guard stopper that prevents said splash guard from rising upward;

wherein said splash guard forms a cavity under said drinking hole; and wherein at least one gripping projections on said cover and said at least one gripping projection and said at least one gripping projection being removably engaged with said at least one locking projection and said at least one gripping projection locks said cover by engaging with said at least one locking projection.

8. The lid for a cup according to claim 7, wherein said base and said cover each further comprise at least one feature selected from the group consisting of ridge, projection, and combinations thereof, and wherein said features mate with one another to secure said cover in an open position.

9. The lid for a cup according to claim 7, wherein said base further comprises a splash guard stopper in proximity to said splash guard.

10. The lid for a cup according to claim 7, further comprising:

a terminal base projection which extends around an entire perimeter at said bottom of said base;

a terminal cover projection at a bottom of said cover which engages with said terminal base projection;

wherein engagement of said terminal cover projection and said terminal base projection facilitates rotation of said cover around said base.

11. A lid for a cup, comprising:

a base which comprises a top and a bottom and said base having a drinking hole, at least one locking projection and a vent hole;

a cover affixed to said base which extends from said top to said bottom of said base and said cover being rotatablely attached to said base and there being a gap between said base and said cover;

wherein said cover is rotatable and comprises at least a first and a second position;

wherein said cover comprises a top surface which is generally flat;

at least one adjustment ridge on said base which extends around an entire perimeter of said base;

at least one securing projection on said cover which engages with said at least one ridge;

a ramp projecting upwards from said top of said base and towards said cover, such that a top of said ramp comprises a topmost area on said base;

a drinking hole in said ramp;

a stopper on said cover;

wherein at least a part of said stopper is removably attachable within said drinking hole;

wherein an outside of said base further comprises a ridge under said drinking hole;

wherein said cover further comprises a projection which engages with said ridge;

wherein said first position is when said ridge is engaged with said drinking hole;

wherein said second position is when said stopper is rotated directly across, or 180° away, from said drinking hole, and wherein at least one gripping projections on said cover and said at least one gripping projection and said at least one gripping projection being removably engaged with said at least one locking projection and said at least one gripping projection locks said cover by engaging with said at least one locking projection.

12. A lid for a cup according to claim 11, wherein said stopper is recessed from said generally flat top surface.

13. A lid for a cup according to claim 11, wherein said ridge forms a splash guard which projects from a first perimeter towards a second perimeter.

14. A lid for a cup according to claim 13, wherein said splash guard projects under an entire area exposed by said hole such that any liquid in said cup must travel around said splash guard to access said hole.

15. The lid for a cup according to claim 13, wherein said base further comprises a splash guard stopper in proximity to said splash guard.

16. The lid for a cup according to claim 11, wherein said base and said cover each further comprise at least one feature selected from the group consisting of an adjustment ridge, securing projection, and combinations thereof, and wherein said features mate with one another to secure said cover in an open position.

17. The lid for a cup according to claim 11, wherein said base further comprises a heat indicator.

18. The lid for a cup according to claim 11, wherein when said cover is in said second position, no part of said cover is covering or engaged with said hole or said ramp.

19. The lid for a cup according to claim 11, further comprising:

a terminal base projection which extends around an entire perimeter at said bottom of said base;

a terminal cover projection at a bottom of said cover which engages with said terminal base projection;

wherein engagement of said terminal cover projection and said terminal base projection facilitates rotation of said cover around said base.

* * * * *